United States Patent [19]

Wilmes

[11] Patent Number: 4,536,049

[45] Date of Patent: Aug. 20, 1985

[54] CUTTING CONNECTOR

[75] Inventor: Manfred Wilmes, Detmold, Fed. Rep. of Germany

[73] Assignee: C. A. Weidmuller GmbH & Co., Detmold, Fed. Rep. of Germany

[21] Appl. No.: 530,134

[22] Filed: Sep. 7, 1983

[30] Foreign Application Priority Data

Sep. 9, 1982 [DE] Fed. Rep. of Germany ..... 3233458

[51] Int. Cl.[3] ..... H01R 13/39

[52] U.S. Cl. ..... 339/97 R; 339/266 R

[58] Field of Search ..... 339/97 R, 97 P, 98, 339/99 R, 266 R

[56] References Cited

U.S. PATENT DOCUMENTS 3,801,952 4/1974 Lawlor ..... 339/266 R
4,019,801 4/1977 Hoffman ..... 339/98
4,085,995 4/1978 Kautz ..... 339/97 R

FOREIGN PATENT DOCUMENTS 2042284 9/1980 Fed. Rep. of Germany .... 339/97 P

*Primary Examiner*—Joseph H. McGlynn
*Attorney, Agent, or Firm*—Sprung Horn Kramer & Woods

[57] ABSTRACT

A cutting connector with two contact knives on its contact part that cut through the insulation on an electric conductor grasped between them to establish electric contact. A U-shaped bent piece pivots on one contact knife surrounding the contact knives above and below to a greater or lesser extent in accordance with how far it is pivoted and having two take-along openings through which the insulated conductor is inserted. The activating member and its motion require very little space. One of the contact knives itself is employed as a pivot for the activating member.

7 Claims, 6 Drawing Figures

CUTTING CONNECTOR

BACKGROUND OF THE INVENTION

The present invention relates to a cutting connector with two contact knives that accept a conductor between them and an activating member that can be displaced relative to them and is provided with take-along openings for the insulated conductor.

Cutting connectors of this type are known in relation to terminal strips as disclosed in German Pat. No. 2 902 536. The activating members of their cutting connectors are pivoting arms or slides made of an electrically insulating material and mounted or positioned on the housing, also made of insulating material, of the strip. The activating members enable an insulated electric conductor to be inserted into a conductor seat between the two contact knives, with the insulation being cut and the metal core of the conductor lightly grasped, and the resulting connection to be later released again.

The design and position of the activating member in the known cutting connector, however, demands a relatively large space which is not available in all applications.

SUMMARY OF THE INVENTION

The object of the present invention is to accordingly provide a cutting connector of the same generic type that requires very little room and can be employed in a very limited space.

This objective is achieved in accordance with the present invention wherein the activating member is a shaped part mounted in such a way as to pivot on one of the contact knives, surrounding the contact knives above and below to a greater or lesser extent in accordance with how far it is pivoted, and having an activating element. Mounting the activating member on one of the contact knives itself and positioning the shaped piece around the knife or knives results in a cutting connector that requires a minimum of space because the only areas of the shaped piece that project beyond the contact knife are the outside connection area between the areas of the piece situated above and below the knife and the area where the take-along openings for the insulated conductor are located when the connector is open. The pivoting motion of the activating member will also require very little space in relation to the full extent of the contact knives. In a cutting connector of this type, the activating member will increase the space needed in any case for the contact knives only slightly.

Another considerable advantage of the invention is that no additional space will be taken up in the insulating housing for the activating-member pivot. This significant extends the range of application of a cutting connector of this type. Specifically, it now becomes possible to design a long connecting strip with a larger number of connections points and to equip each connecting point as a cutting connector.

Other preferred embodiments of a cutting connector of this type provide, in particular, designs that contribute to the minimum space requirements and simple construction of the connector.

In one preferred embodiment the activating member is a U-shaped bent piece with the take-along openings in the opposing legs on one side and the pivot on the other side. The pivot is preferably constituted by a hole in one contact knife and by a corresponding round raised area in one leg of the U-shaped bent piece. Moreover, the activating element is preferably a screwdriver-access opening in the leg of the shaped piece above the contact knife.

In another preferred embodiment, at least the contact knife that supports the activating member has a rounded outside edge that matches the radius of pivot of the activating member.

The cutting connector also preferably comprises a catch that establishes the closed position of the activating member and that is located on one of the contact knives.

The contact knives may also be part of a connector strip with a number of pairs of such contact knives thereon.

One embodiment of the invention will now be described by way of example with reference to the drawing, in which

DETAILED DESCRIPTION OF THE INVENTION

Figures 1, 2:
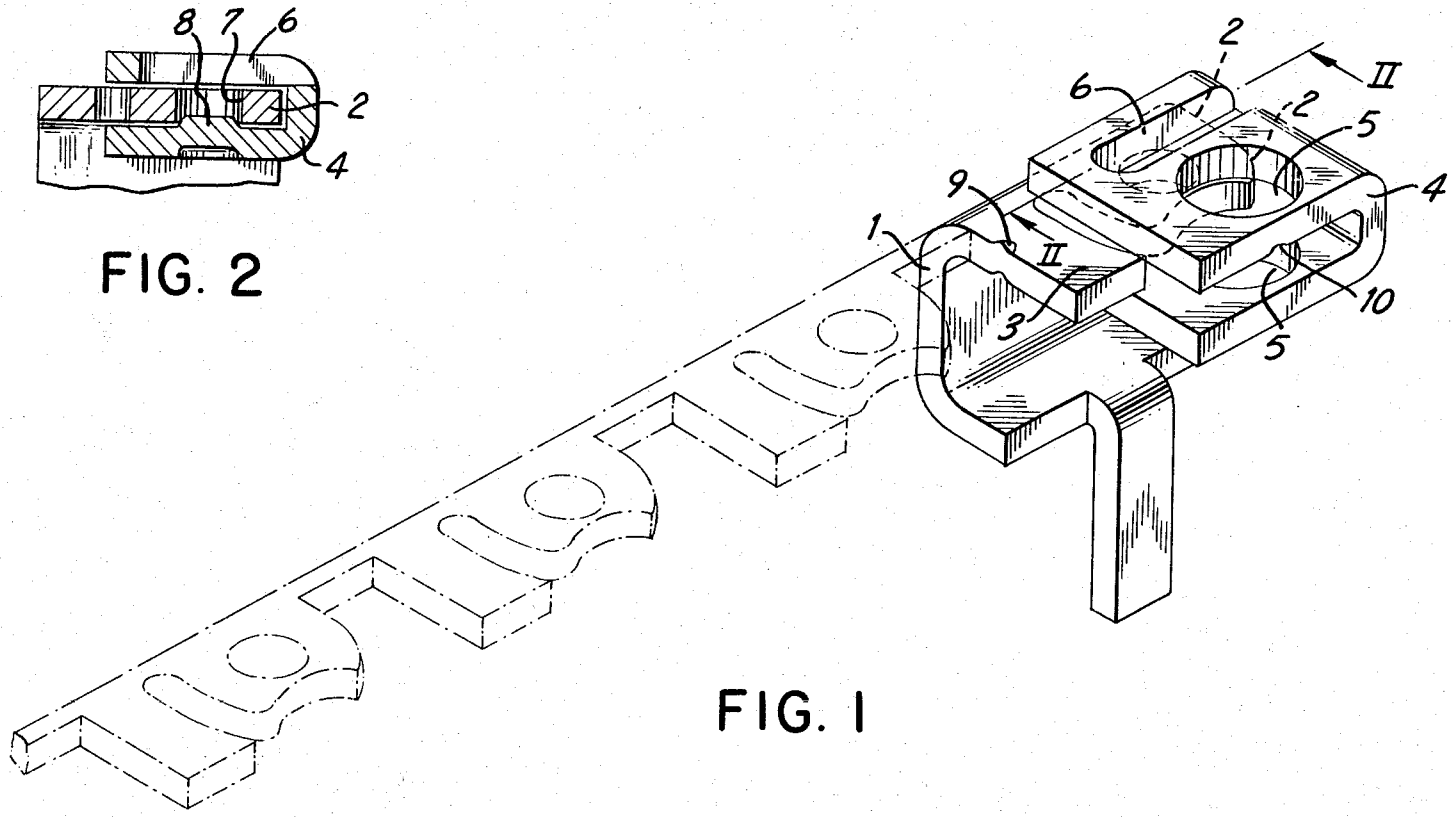
FIG. 1 is a perspective view of a cutting connector.
FIG. 2 is a partial section through the connector in FIG. 1 along line II—II.
Figure 3A:
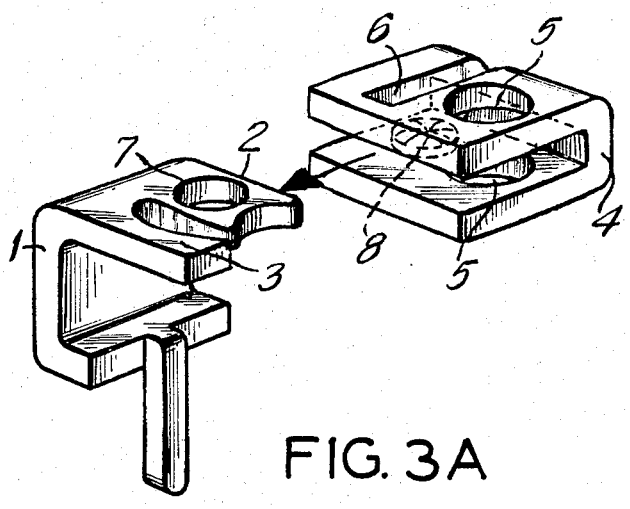
FIGS. 3A–3D show the operation of attaching a wire to the connector of FIG. 1.
Figure 3B:
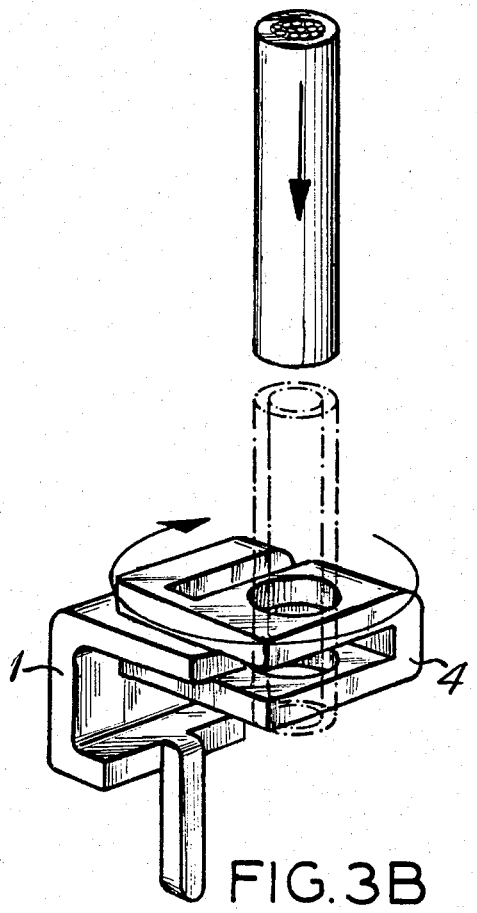
Figure 3C:
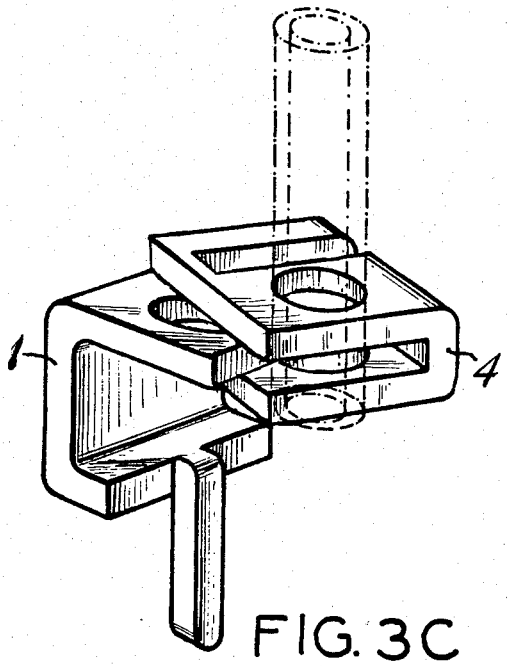
Figure 3D:
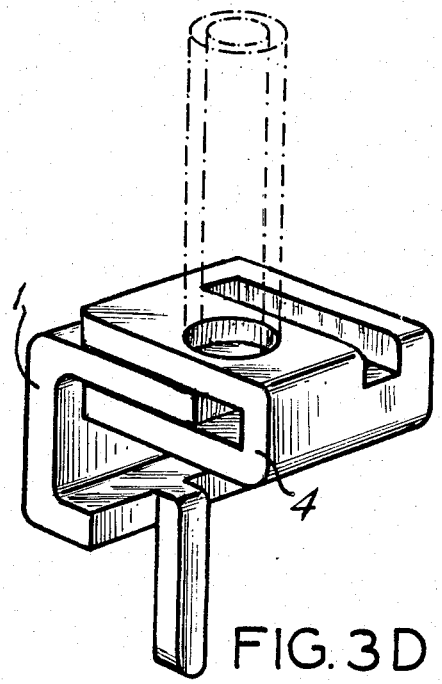

Referring now to FIGS. 1–2, the cutting connector has two contact knives 2 and 3 on its contact part 1. The edges of the knives that face and oppose each other are cutting edges and they are far enough apart to cut the insulation of a conductor forced between them and lightly grasp the metal core of the conductor to produce the desired contact.

An activating member 4 is mounted in such a way as to pivot on one contact knife 2. The activating member in the embodiment illustrated is a U-shaped bent piece that surrounds the contact knives above and below to a greater or lesser extent depending on how far it has been pivoted.

There are two take-along openings 5, one directly above the other, in the area of the two legs of U-shaped bent piece 4 that are in front of contact knife 2 when activating member 4 is open. The insulated conductor that is to be grasped between contact knives 2 and 3 is inserted through take-along openings 5.

There is a screwdriver-access opening 6 adjacent to the take-along opening 5 in the leg of U-shaped bent piece above contact knife 2. Opening 6 is an activating opening for activating member 4, allowing the member to be pivoted, obviously very simply, into and out of its closure position with a screwdriver.

The pivot is very simply constituted as will be evident from FIG. 2 by a hole 7 in contact knife 2 and by a round raised area 8 in the leg of the U-shaped bent piece below contact knife 2 that engages hole 7.

A snap-in elevation 9 is also stamped onto the contact knife 3 in the embodiment illustrated and a snap-in depression 10 is impressed at a corresponding point on the upper leg of U-shaped bent part 4. The design is such that activating member 4 snaps into place for increased security when it is in the closed position, when, that is, a conductor has been inserted between contact knives 2 and 3, without, however, the catch action being strong enough to impede releasing the contact with a screwdriver.

FIG. 1 illustrates only a single cutting connector. Based on the illustrated embodiment, however, it is possible with no difficulty to design a long connecting strip with a larger number of connection points and to equip each connection point as a cutting connector. Contact knives 2 and 3 will then become parts of the type of connector strip indicated as a potential embodiment by the dot-and-dash lines in FIG. 1.

What also contributes to minimum space requirements is that at least contact knife 2, which supports activating member 4, has a rounded outside edge that matches the radius of pivot of activating member 4 so that the member can be positioned around the outer edge of contact knife 2 as narrowly as possible as it is moved from its open position into its closed position with the conductor inserted between contact knives 2 and 3.

FIGS. 3A–3D show the step by step operation by which a wire is attached to contact part 1.

What is claimed is:

1. In a cutting connector having two spaced apart contact knives for cutting through wire insulation to receive a conductor therebetween and an activating member displaceable relative to the knives and with openings receptive of the insulated conductor to dispose the conductor between the knives upon displacement of the activating member, the improvement wherein: the activating member comprises a U-shaped element having opposing legs with said openings therein and means mounting the U-shaped element with one contact knife disposed between the opposing legs for pivoting movement on said one contact knife between an open position wherein said openings are outside the contact knives and a closed position wherein the openings are above and below the contact knives, and wherein the U-shaped element is configured to surround the contact knives, during the pivoting movement thereof, to a variable extent which is a function of the position of the U-shaped element and the U-shaped element includes means thereon for effecting pivotal movement thereof in response to a manually applied force.

2. The cutting connector as in claim 1, wherein the openings in the opposing legs are on one side thereof and the mounting means are on the other side.

3. The cutting connector as in claim 1, wherein the mounting means comprises a hole in said one contact knife and a corresponding round raised area in one leg of the U-shaped element.

4. The cutting connector as in claim 1, wherein the pivoting means comprises a screwdriver-access opening in the leg of the U-shaped element disposed above the one contact knife.

5. The cutting connector as in claim 1, wherein at least said one contact knife has a rounded outside edge that matches the radius of pivoting of the U-shaped element.

6. The cutting connector as in claim 1, further comprising a catch disposed on one contact knife and one leg of the U-shaped element to define the closed position of the activating member.

7. The cutting connector as in claim 1, wherein the contact knives are part of a connector strip with a plurality of pairs of contact knives.

* * * * *